US008674925B2

(12) United States Patent
Jung et al.

(10) Patent No.: US 8,674,925 B2
(45) Date of Patent: Mar. 18, 2014

(54) DISPLAY APPARATUS AND BACKLIGHT SCANNING METHOD THEREOF

(75) Inventors: Jun-ho Jung, Seoul (KR); Hyung-rae Kim, Seoul (KR); Yung-jun Park, Yongin-si (KR); Jun-ho Sung, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 806 days.

(21) Appl. No.: 11/774,831

(22) Filed: Jul. 9, 2007

(65) Prior Publication Data

US 2008/0165117 A1 Jul. 10, 2008

(30) Foreign Application Priority Data

Jan. 7, 2007 (KR) ..... 10-2007-0001823

(51) Int. Cl.
*G09G 3/36* (2006.01)

(52) U.S. Cl.
USPC ..... 345/102

(58) Field of Classification Search
USPC ..... 345/102
See application file for complete search history.

(56) References Cited

U.S. PATENT DOCUMENTS 7,277,079 B2 * 10/2007 Kobayashi et al. ..... 345/102
2003/0011614 A1 * 1/2003 Itoh et al. ..... 345/589
2005/0206589 A1 * 9/2005 Miyachi et al. ..... 345/73
2006/0038771 A1 * 2/2006 Hirakata et al. ..... 345/102
2006/0146005 A1 * 7/2006 Baba et al. ..... 345/102
2008/0094383 A1 * 4/2008 Stessen et al. ..... 345/209
2010/0020002 A1 * 1/2010 Van Woudenberg et al. . 345/102

FOREIGN PATENT DOCUMENTS

CN 1560679 A 1/2005
WO 2006/070323 A1 7/2006

OTHER PUBLICATIONS

Chinese Office Action issued on Sep. 7, 2010 in the corresponding Chinese Patent Application No. 200710141900.8.

* cited by examiner

*Primary Examiner* — William Boddie
(74) *Attorney, Agent, or Firm* — Sughrue Mion, PLLC

(57) ABSTRACT

A display apparatus and a backlight scanning method thereof are provided. The display apparatus having a backlight illuminator includes a parameter generator for generating parameters indicative of motion features of a video signal; and a backlight driver for driving the backlight illuminator by generating a scanning signal which has a plurality of scanning pulses during a frame period and is adjusted according to the parameters generated at the parameter generator. The display apparatus and the backlight scanning method thereof drive the backlight by generating the scanning signal which has the plurality of the scanning pulses during the frame period and is adjusted according to the motion features of the video signal to be displayed, to thereby effectively mitigate the motion blur and the flicker.

22 Claims, 5 Drawing Sheets

DISPLAY APPARATUS AND BACKLIGHT SCANNING METHOD THEREOF

CROSS-REFERENCE TO RELATED APPLICATIONS

This application claims the benefit under 35 U.S.C. §119(a) of Korean Patent Application No. 10-2007-0001823, filed on Jan. 7, 2007, in the Korean Intellectual Property Office, the entire disclosure of which is hereby incorporated by reference.

BACKGROUND OF THE INVENTION

1. Field of the Invention

The present invention relates generally to a display apparatus and a backlight scanning method thereof. More particularly, the present invention relates to a display apparatus for effectively mitigating motion blur and flicker, and a backlight scanning method for the display apparatus.

2. Description of the Related Art

A liquid crystal display (LCD), which is the representative display apparatus, is generally used to display images on a monitor such as television, notebook computer, and desktop computer. Since the LCD cannot produce light by itself, it has to utilize the light illuminated from a separate light source. Hence, by using a backlight illuminating behind an LCD panel generally, the LCD represents images by adjusting transmittance of the light illuminated from the backlight according to the movement of the liquid crystals.

Mostly, the backlight has been driven in a hold type which maintains an ON state all the time when power is applied to the LCD. However, when changing from one image to another image, this backlight driving method causes image smearing, that is, causes motion blurring. To address this drawback, suggested is a scanning method which sequentially turns on backlights from top to bottom.

FIG. 1 depicts a related art scanning method in which a backlight driver is used. A scanning signal generator 110 of the backlight driver 100 generates scanning signals in synchronization with a vertical synchronizing signal of a video signal. Line block drivers 120 drive line blocks of the backlight based on the generated scanning signals.

FIG. 2 depicts scanning signals for driving the respective line blocks. In FIG. 2, the backlight is divided to five line blocks and sequentially scanned. Each line block manages a certain number of lines. Each line block is turned on and off for a unit time. Accordingly, the scanning signal of the line block has one pulse for the unit time.

The related art scanning method can mitigate the motion blur, but cannot effectively reduce flickering. In detail, when the backlight is generally scanned based on the vertical frequency 60 Hz of the video signal of the NTSC standard, flicker is viewable in the motionless images of bright gradation. This is because the human eye is far more sensitive to flicker in this case.

SUMMARY OF THE INVENTION

Accordingly, an exemplary aspect of the present invention is to provide a display apparatus for effectively mitigating motion blur and flicker by generating scanning signals which are adjusted according to motion features of a video signal to be displayed, with a plurality of scanning pulses during a frame period and thus driving a backlight, and a backlight scanning method of the display apparatus.

According to an aspect of the present invention, a display apparatus having a backlight illuminator comprises a parameter generator for generating parameters indicative of motion features of a video signal; and a backlight driver for driving the backlight illuminator by generating a scanning signal which has a plurality of scanning pulses during a frame period and is adjusted according to the parameters generated at the parameter generator.

The backlight driver may drive the backlight illuminator by generating the scanning signal which has a first scanning pulse and a second scanning pulse.

The backlight driver may drive the backlight illuminator by adjusting a start point of the second scanning pulse.

The backlight driver may drive the backlight illuminator by adjusting the scanning signal so that the start point of the second scanning pulse becomes more distant from a start point of the first scanning pulse when the parameters indicate no motion.

The backlight driver may drive the backlight illuminator by adjusting a pulse width of the first and second scanning pulses.

The backlight driver may drive the backlight illuminator by adjusting the scanning signal to decrease the pulse width of the first scanning pulse and to increase the pulse width of the second scanning pulse when the parameters indicate no motion.

The backlight driver may drive the backlight illuminator by generating the scanning signal which has an initial scanning pulse and following scanning pulses.

The backlight driver may drive the backlight illuminator by adjusting a pulse width of the initial scanning pulse and a number of the following scanning pulses.

The backlight driver may drive the backlight illuminator by adjusting the scanning signal to increase the pulse width of the initial scanning pulse as long as the pulse width of one of the following scanning pulses and to decrease the number of the following scanning pulses by one when the parameters indicate the motion.

The backlight driver may drive the backlight illuminator by adjusting the number of the following scanning pulses to drop either an initial pulse or a final pulse of the following scanning pulses.

The parameters may indicate presence or absence of the motion, or amount of the motion.

The backlight illuminator may use one of a light emitting diode (LED), a cold cathode fluorescent lamp (CCFL), a hot cathode fluorescent lamp (HCFL), a surface-conduction electron-emitter display (SED), and a field emission display (FED).

The backlight driver may generate the scanning signal by synchronizing with a vertical synchronizing signal of the video signal.

According to the aspect of the present invention, a backlight apparatus having a backlight illuminator includes a parameter generator for generating parameters indicative of motion features of a video signal; and a backlight driver for driving the backlight illuminator by generating a scanning signal which has a plurality of scanning pulses during a frame period and is adjusted according to the parameters generated at the parameter generator.

According to the aspect of the present invention, a backlight scanning method of a display apparatus includes generating parameters indicative of motion features of a video signal; and generating a scanning signal which has a plurality of scanning pulses during a frame period and is adjusted according to the parameter; and driving a backlight using the generated scanning signal.

Other aspects of the invention will become apparent from the following detailed description, which, taken in conjunction with the annexed drawings, discloses exemplary embodiments of the invention.

BRIEF DESCRIPTION OF THE DRAWING FIGURES

The above aspects and features of the present invention will be more apparent by describing certain exemplary embodiments of the present invention with reference to the accompanying drawings, in which.

DETAILED DESCRIPTION OF EXEMPLARY EMBODIMENTS

Certain exemplary embodiments of the present invention are described below in greater detail with reference to the accompanying drawings.

The matters defined in the description, such as a detailed construction and elements thereof, are provided to assist in a comprehensive understanding of the exemplary embodiments of the invention and are merely exemplary. Accordingly, those of ordinary skill in the art will recognize that various changes and modifications of the exemplary embodiments described herein can be made without departing from the scope and spirit of the invention. Descriptions of well-known functions and constructions are omitted for clarity and conciseness.

Figure 1:
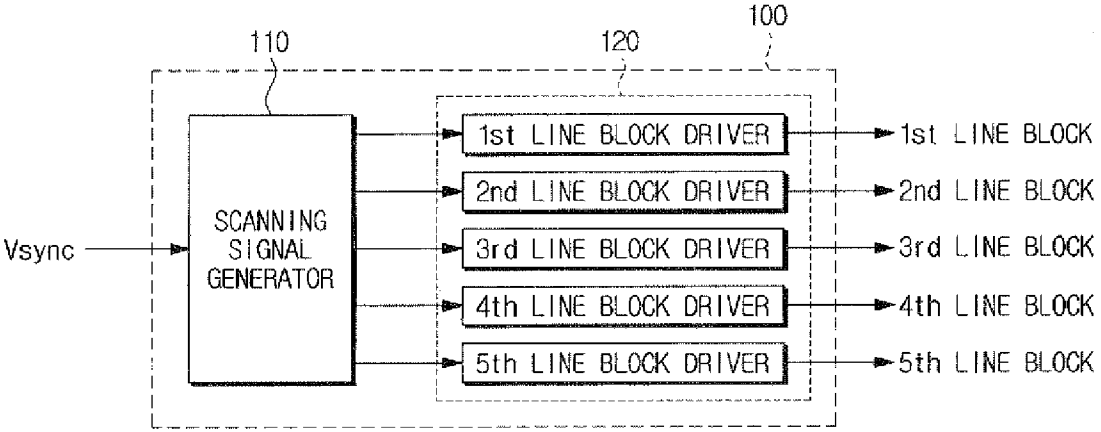
FIG. 1 (RELATED ART)
FIG. 1 depicts a related art scanning method in which a backlight driver is used.
Figure 2:
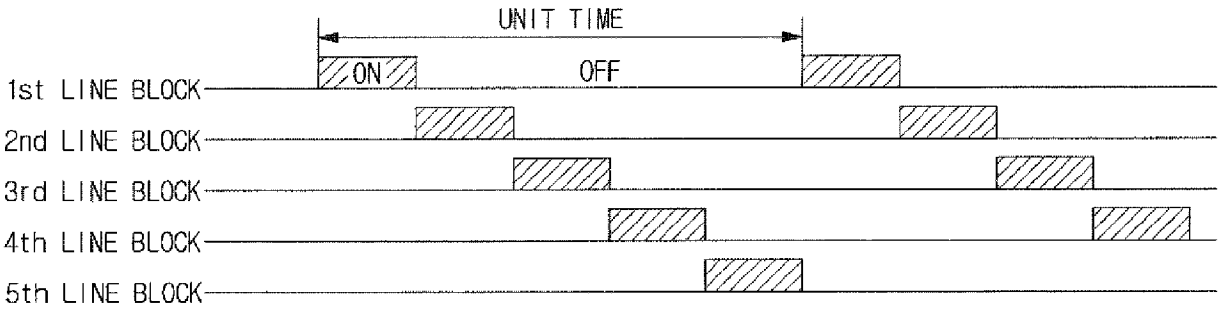
FIG. 2 (RELATED ART)
FIG. 2 depicts scanning signals generated by the backlight drivers of FIG. 1.
Figure 3:
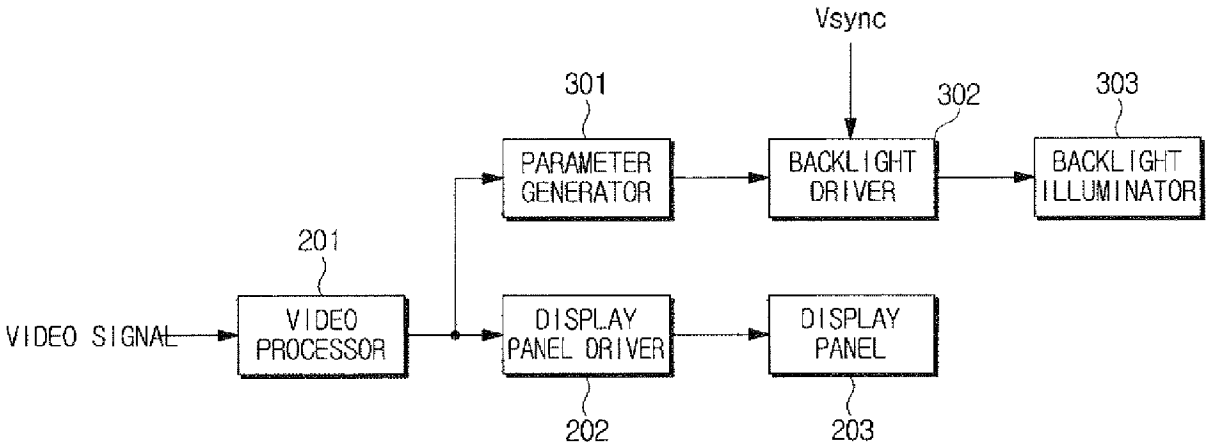
FIG. 3 is a block diagram of a display apparatus according to an exemplary embodiment of the present invention.

FIG. 3 is a block diagram of a display apparatus according to an exemplary embodiment of the present invention. A video processor 201 receives and processes a video signal to display the video on a display panel. The video signal processed at the video processor 201 is fed to a display panel driver 202. The display panel driver 202 drives a display panel 203 to display the fed video signal on the display panel.

The video signal processed at the video processor 201 is also fed to a parameter generator 301. The parameter generator 301 calculates parameters to extract motion features from the fed video signal. Kinds of the parameters and a method for calculating the parameters will be described later. The parameter generator 301 outputs the calculated parameters to a backlight driver 302.

The backlight driver 302 serves to drive a backlight illuminator 303 by generating scanning signals, which have a plurality of scanning pulses within one frame period and are regulated according to the parameters generated at the parameter generator 301. By generating the scanning signal to have a plurality of scanning pulses while constantly maintaining the total duty ratio of the scanning signals, the scanning driving frequency can increase and thus the flicker reduction effect can be improved. The scanning signal of the plurality of the scanning pulses can be generated to synchronize with the vertical synchronizing signals of the video signal to be displayed on the display panel 203 of the display apparatus.

The scanning signals generated at the backlight driver 302 are regulated according to the parameters which are generated at the parameter generator 301 and indicative of motion features. The regulation of the scanning signals will be explained later in detail.

The backlight illuminator 303 gives off the light to the display panel 203 of the display apparatus. Light source of the backlight illuminator 303 can use any one of a light emitting diode (LED), a cold cathode fluorescent lamp (CCFL), a hot cathode fluorescent lamp (HCFL), a surface-conduction electron-emitter display (SED), and a field emission display (FED). The backlight illuminator 303 is divided to a certain number of regions and scanned_by the backlight driver 302. The regions can be distinguished by a line or block. Herein, the blocks can be a certain number of blocks (e.g., 8×8=64 blocks) of the backlight illuminator 303, and the backlight driver can turn on and off each of the blocks.

The parameters generated at the parameter generator 301 include a motion parameter indicative of presence or absence of motion, and an edge parameter indicative of the amount of motion.

The motion parameter can be calculated based on Equation 1 by dividing the backlight illuminator 303 to certain units.

$$BLK(x, y) = \sum_{m} \sum_{n} |Y(m, n) - Y'(m, n)| \quad \text{[Equation 1]}$$

In Equation 1, m, n are coordinates of pixels in the block x, y. Y(m, n) and Y'(m, n) are luminance values at the coordinates m, n of the pixels of each frame. Ultimately, Equation 1 represents sum of absolute differences (SAD) of the luminance values of the pixels between two frames of the block (x, y).

When BLK(x, y) value, that is, the SAD value of BLK(x, y) is extracted and greater than a threshold, the motion parameter is set to 1. When the SAD value is less than or equal to the threshold, the motion parameter is set to 0. Note that those set values are exemplary. When the SAD value is greater than the threshold, it is determined that there is motion between two frames. When the SAD value is less than or equal to the threshold, it is determined that there is no motion between two frames.

The SAD value of BLK(x, y) can be represented as bits to use it as the motion parameter. Motion vectors can be estimated using the motion estimation method and used as the motion parameter.

After the motion parameter is determined, a final motion parameter of the target block can be determined based on motion parameters of neighbor blocks based on Equation 2.

$$S = \sum_{m=x-1}^{x+1} \sum_{n=y-1}^{y+1} M(m, n) \quad \text{[Equation 2]}$$

In Equation 2, m, n are coordinates of the blocks and x, y are coordinates of the target block. M denotes the motion parameter generated based on Equation 1.

Accordingly, S is the summation of the motion parameters of the target block and the eight neighbor blocks. When S is greater than a threshold, the final motion parameter of the target block is defined to 1. When S is less than or equal to the threshold, the final motion parameter of the target block is defined to 0. In other words, the final motion parameter greater than the threshold implies the presence of the motion.

As such, the parameter generator 301 generates and outputs the motion parameter to the backlight driver 302.

In addition, the parameter generator 301 calculates and outputs the edge parameter to the backlight driver 302.

The edge parameter detects how many edges are between the background and the object of the video signal to be displayed on the display panel 203. Many edges implies fast motion. By summing up the edges of each block using an edge detection filter and comparing the sum with a threshold, when the sum of the detected edges is greater than the threshold, the edge parameter can be set to 1. When the sum is less than or equal to a threshold, the edge parameter can be set to 0. Note that the set values of "1" and "0" for the edge, motion, and final motion parameters are exemplary.

The motion parameter and the edge parameter generated at the parameter generator 301 are fed to the backlight driver 302 and reflected to adjust the scanning signals.

Now, the following descriptions explain how the motion parameter and the edge parameter fed to the backlight driver 302 are reflected in the adjustment of the scanning signals according to exemplary embodiments of the present invention.

Figure 4:
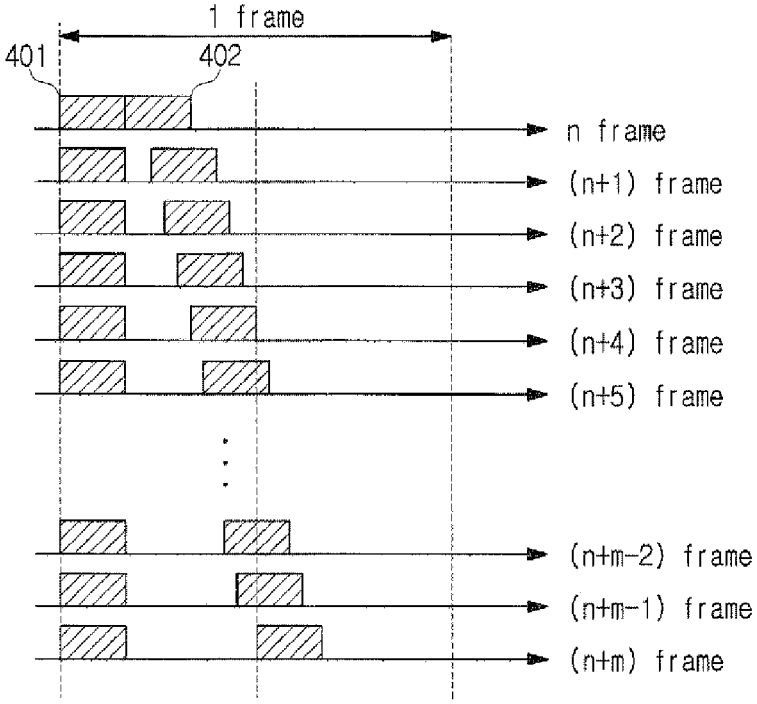
FIG. 4 depicts a backlight scanning method according to one exemplary embodiment of the present invention.

FIG. 4 depicts a scanning signal adjusting method according to one exemplary embodiment of the present invention.

The scanning signal generated at the backlight driver 302 includes a first scanning pulse 401 and a second scanning pulse 402. The first scanning pulse 401 synchronizes with the vertical synchronizing signal of the video signal to be displayed on the display panel. The start point of the second scanning pulse 402 is adjustable for each frame.

As shown in FIG. 4, when the motion parameter 0 is input continually, that is, it is determined that there is no motion as the frame proceeds from n frame to (n+m) frame, the start point of the second scanning pulse 402 gradually moves away from the first scanning pulse as represented in the (n+m) frame. At this time, the flicker reduction effect increases. Since the possibility of generating flicker increases when no motion is present, it is necessary to adjust the scanning signal so as to enhance the flicker reduction effect. It is preferred that the start point of the second scanning pulse 402 does not go beyond the half of the frame period in order to block the influence on the next frame.

FIG. 4 shows the case where it is continually determined that there is no motion as the frame increases. If the motion parameter 1 is input in any frame, that is, if it is determined that there is motion, the start point of the second scanning pulse 402 is shifted toward the first scanning pulse 401 to enhance the motion blur effect.

Therefore, the start point of the second scanning pulse 402 can be adjusted depending on the presence or absence of the motion.

Even though in case that it is necessary to enhance the flicker reduction since it is determined that there is no motion as the frame proceeds, immediately changing the scanning signal to the (n+m) frame type which has the greater flicker reduction effect may cause another flicker. Thus, the start point of the second scanning pulse 402 is gradually adjusted as shown in FIG. 4.

The edge parameter generated at the parameter generator 301 can be reflected in the adjustment of the scanning signal. When it is determined that there is motion and that there are many edges, how far the second scanning pulse 402 is shifted toward the first scanning pulse 401 is determined. In this case, since the possibility of generating the flicker is less and the possibility of generating the motion blur is great due to the fast motion, the scanning signal can be adjusted to rapidly mitigate the motion blur. Accordingly, in case that it is determined that there is motion and that there are many edges, that is, when the motion parameter is 1 and the edge parameter is 1, the width by which the second scanning pulse 402 is shifted toward the first scanning pulse 401 is adjusted to be greater than the previous frame. For instance, the scanning signal can be adjusted from the scanning signal of the (n+3) frame type directly to the scanning signal of the n frame type in FIG. 4.

Figure 5:
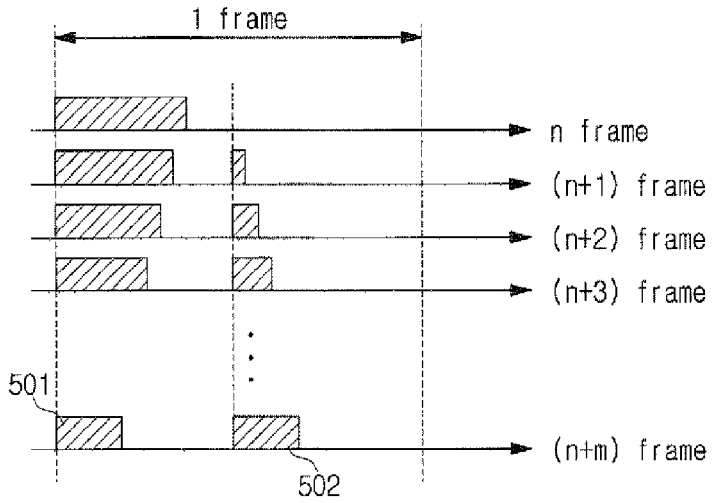
FIG. 5 depicts a backlight scanning method according to another exemplary embodiment of the present invention.

FIG. 5 depicts a scanning signal adjusting method according to another exemplary embodiment of the present invention.

Unlike the first exemplary embodiment of the present invention, the start point of a second scanning pulse 502 is fixed to the half of a frame period and the scanning signal of the n frame type is changed toward the scanning signal of the (n+m) frame type every time the motion parameter 0 is input, that is, every time it is determined that there is motion as the frame proceeds according to a second exemplary embodiment of the present invention. As one can see, in the second exemplary embodiment of the present invention, every time the motion parameter 0 is input, the total duty ratio is constantly maintained, decreasing the pulse width of the first scanning pulse 501 and increasing the pulse width of the second scanning pulse 502. It is preferred that the pulse width of the second scanning pulse 502 does not exceed half of the total duty ratio as shown in FIG. 5 so as to block the influence on the next frame.

As in the first exemplary embodiment, when it is determined that there is motion, the scanning signal may be adjusted to increase the pulse width of the first scanning pulse 501 and decrease the pulse width of the second scanning pulse 502 as the frame proceeds in the upward direction of FIG. 5.

The backlight driver 202 can receive the edge parameter and determine how many frames are passed through to adjust the scanning signal of the n frame type to the scanning signal of the (n+m) frame type.

Figure 6:
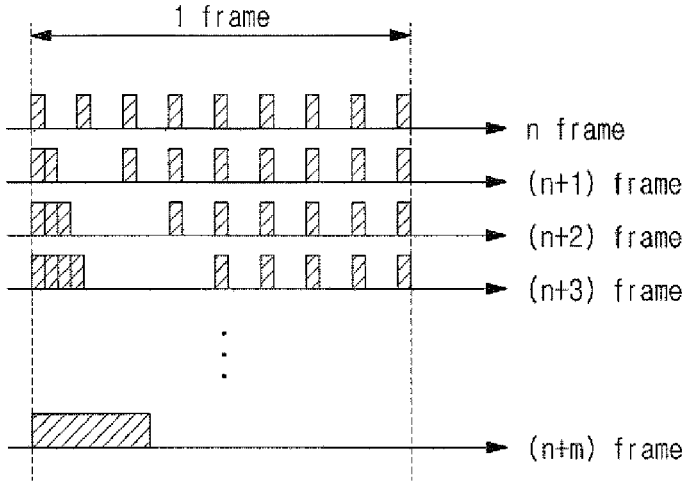
FIG. 6 depicts a backlight scanning method according to still another exemplary embodiment of the present invention.

FIG. 6 depicts a scanning signal adjusting method according to still another exemplary embodiment of the present invention.

The backlight driver 302 can generate the backlight scanning signal in synchronization with the vertical synchronizing signal of the video signal, and the scanning signal can have a plurality of scanning pulses with the same pulse width.

FIG. 6 shows the change to the scanning signal of (n+m) frame type every time the motion parameter 1 is input, that is, every time it is determined that there is motion as the frame proceeds.

Every time the motion parameter 1 is input, that is, every time it is determined that there is motion as the frame increases, a second scanning pulse of the plurality of the scanning pulses is added to an initial scanning pulse. In other words, the pulse width of the initial scanning pulse is adjusted to extend as long as the initial pulse of the following scanning pulses.

When it is determined that there is no motion, the scanning signal is adjusted in the upward direction of FIG. 6, thus enhancing the flicker reduction effect.

As in the first and second exemplary embodiments of the present invention, the edge parameter can be reflected to determine how many frames are between the n frame and the (n+m) frame. In detail, since the motion is great when both the motion parameter and the edge parameter are 1, the possibility of generating flicker is less and the possibility of generating motion blur increases. Thus, the scanning signal of the n frame type can be adjusted to the scanning signal of the (n+m) frame type by passing through the less number of frames than illustrated.

Figure 7:
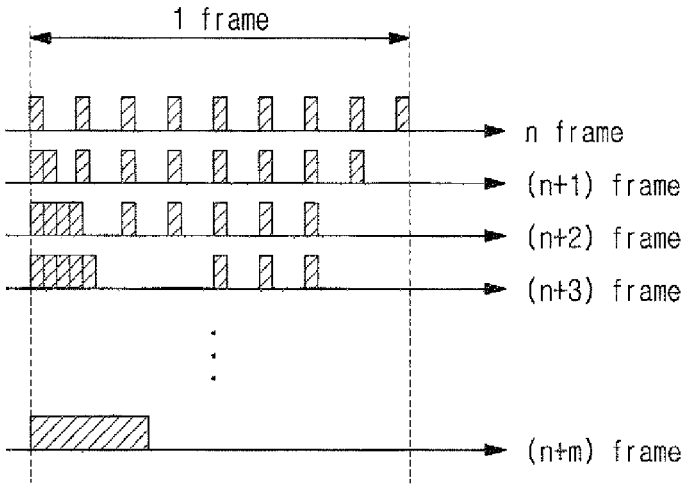
FIG. 7 depicts a backlight scanning method according to yet another exemplary embodiment of the present invention.

FIG. 7 depicts a backlight scanning signal adjusting method according to yet another exemplary embodiment of the present invention.

A difference from FIG. 6 is that the last pulse of the following scanning pulses is added to the initial scanning pulse every time the motion parameter is 1, that is, every time it is determined that there is motion. In this case, as in the above exemplary embodiments, the edge parameter can be reflected in determining how many frames lie between the n frame and the (n+m) frame.

Figure 8:
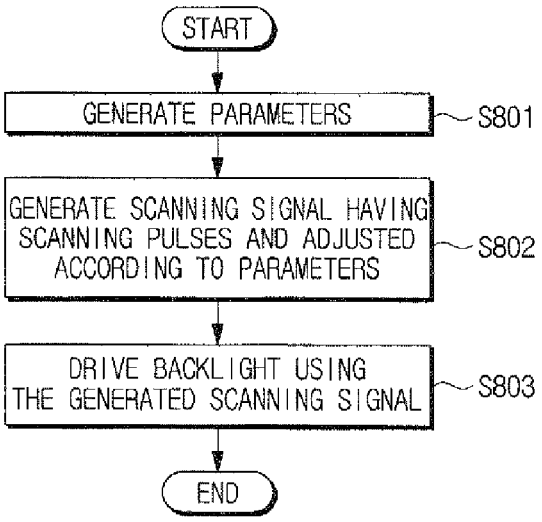
FIG. 8 is a flowchart explaining the backlight scanning method according to an exemplary embodiment of the present invention.

FIG. 8 is a flowchart explaining a backlight scanning method according to an exemplary embodiment of the present invention.

The parameter generator 301 generates the parameters indicative of the motion features of the video signal to be displayed (S801). The parameters, which indicate the presence or absence of the motion, or the amount of the motion, are used to adjust the start point or the pulse width of the plurality of the scanning pulses constituting the scanning signal. The motion parameter indicative of the presence or absence of the motion is acquired using the motion estimation or the motion detection. The edge parameter indicative of the amount of the motion is acquired using the edge detection.

The backlight driver 302 generates the scanning signal which has the plurality of scanning pulses during a frame period and is adjusted according to the parameters (S802). The scanning signal can be generated by synchronizing with the vertical synchronizing signal of the video signal to be displayed.

Next, the backlight illuminator 303 is driven using the adjusted scanning signal.

As set forth above, the display apparatus and the backlight scanning method thereof drive the backlight by generating the scanning signal which has the plurality of the scanning pulses during the frame period and is adjusted according to the motion features of the video signal to be displayed, to thereby effectively mitigate the motion blur and the flicker.

The foregoing exemplary embodiments and advantages are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. A display apparatus having a backlight illuminator, comprising:

a parameter generator which generates parameters indicative of motion features of a video signal; and a backlight driver which drives the backlight illuminator by generating a scanning signal which has a plurality of scanning pulses during a frame period and is adjusted according to the parameters generated by the parameter generator, wherein the backlight driver drives the backlight illuminator by generating the scanning signal which has a first scanning pulse and a second scanning pulse during the frame period, wherein the backlight driver drives the backlight illuminator by adjusting a start point or a pulse width of the second scanning pulse differently for each frame, and wherein an initial scanning pulse of the generated scanning signal is synchronized with a vertical synchronization signal so that the start point of the initial scanning pulse is consistent for each frame, wherein the backlight driver drives the backlight illuminator by adjusting the scanning signal to decrease the pulse width of the first scanning pulse and to increase the pulse width of the second scanning pulse while maintaining a total duty ratio constantly when the parameters indicate no motion, and wherein a start point of the second scanning pulse is not adjusted according to the parameters while the pulse width of the second scanning pulse is increased when the parameters indicate no motion.

2. The display apparatus of claim 1, wherein the backlight driver drives the backlight illuminator by adjusting a start point of the second scanning pulse.

3. The display apparatus of claim 1, wherein the backlight driver drives the backlight illuminator by adjusting a pulse width of the first and second scanning pulses.

4. The display apparatus of claim 1, wherein the backlight driver drives the backlight illuminator by generating the scanning signal which has an initial scanning pulse and following scanning pulses.

5. The display apparatus of claim 4, wherein the backlight driver drives the backlight illuminator by adjusting a pulse width of the initial scanning pulse and a number of the following scanning pulses.

6. The display apparatus of claim 5, wherein the backlight driver drives the backlight illuminator by adjusting the scanning signal to increase the pulse width of the initial scanning pulse as long as the pulse width of one of the following scanning pulses and to decrease the number of the following scanning pulses by one when the parameters indicate motion.

7. The display apparatus of claim 6, wherein the backlight driver drives the backlight illuminator by adjusting the number of the following scanning pulses to drop either an initial pulse or a final pulse of the following scanning pulses.

8. The display apparatus of claim 1, wherein the backlight illuminator uses one of a light emitting diode (LED), a cold cathode fluorescent lamp (CCFL), a hot cathode fluorescent lamp (HCFL), a surface-conduction electron-emitter display (SED), and a field emission display (FED).

9. The display apparatus of claim 1, wherein the backlight driver generates the scanning signal by synchronizing with a vertical synchronizing signal of the video signal.

10. The display apparatus of claim 1, wherein the parameter generator generates a parameter indicative of an amount of motion according to a number of edges between an object and a background of the video signal.

11. The display apparatus of claim 1, wherein the start point of the initial scanning pulse is consistent for each frame and equal to a start point of each frame period.

12. The display apparatus of claim 1, wherein the pulse width of the second scanning pulse does not increase so as to exceed half of the total duty ratio when the parameters indicate no motion.

13. A backlight apparatus having a backlight illuminator, comprising:

a parameter generator which generates parameters indicative of motion features of a video signal; and a backlight driver which drives the backlight illuminator by generating a scanning signal which has a plurality of scanning pulses during a frame period and is adjusted according to the parameters generated by the parameter generator, wherein the backlight driver drives the backlight illuminator by generating the scanning signal which has a first scanning pulse and a second scanning pulse during the frame period, wherein the backlight driver drives the backlight illuminator by adjusting a start point or a pulse width of the second scanning pulse differently for each frame, and wherein an initial scanning pulse of the generated scanning signal is synchronized with a vertical synchronization signal so that the start point of the initial scanning pulse is consistent for each frame, wherein the backlight driver drives the backlight illuminator by adjusting the scanning signal to decrease the pulse width of the first scanning pulse and to increase the pulse width of the second scanning pulse while maintaining a total duty ratio constantly when the parameters indicate no motion, and wherein a start point of the second scanning pulse is not adjusted according to the parameters while the pulse width of the second scanning pulse is increased when the parameters indicate no motion.

14. A backlight scanning method of a display apparatus, the method comprising:

generating parameters indicative of motion features of a video signal; and generating a scanning signal which has a plurality of scanning pulses during a frame period and is adjusted according to the parameters; and driving a backlight using the generated scanning signal, wherein the scanning signal is generated to include first and second scanning pulses during the frame period, wherein the scanning signal has a different start point or pulse width of the second scanning pulse for each frame, wherein an initial scanning pulse of the generated scanning signal is synchronized with a vertical synchronization signal so that the start point of the initial scanning pulse is consistent for each frame, adjusting the scanning signal to decrease a pulse width of the first scanning pulse and to increase the pulse width of the second scanning pulse while maintaining a total duty ratio constantly when the parameters indicate no motion, and wherein a start point of the second scanning pulse is not adjusted according to the parameters while the pulse width of the second scanning pulse is increased when the parameters indicate no motion.

15. The backlight scanning method of claim 14, wherein the scanning signal is generated by adjusting a start point of the second scanning pulse.

16. The backlight scanning method of claim 14, wherein the scanning signal is generated by adjusting the pulse width of the first and second scanning pulses.

17. The backlight scanning method of claim 14, wherein the scanning signal is generated to include an initial scanning pulse and following scanning pulses.

18. The backlight scanning method of claim 17, wherein the scanning signal is generated by adjusting a pulse width of the initial scanning pulse and a number of the following scanning pulses.

19. The backlight scanning method of claim 18, wherein, when the parameters indicate motion, the scanning signal is generated by increasing the pulse width of the initial scanning pulse as long as a pulse width of one of the following scanning pulses and decreasing the number of the following scanning pulses by one.

20. The backlight scanning method of claim 19, wherein the number of the following scanning pulses is adjusted by dropping either an initial pulse or a final pulse of the following scanning pulses.

21. The backlight scanning method of claim 14, wherein the backlight is formed using one of a light emitting diode (LED), a cold cathode fluorescent lamp (CCFL), a hot cathode fluorescent lamp (HCFL), a surface-conduction electron-emitter display (SED), and a field emission display (FED).

22. The backlight scanning method of claim 14, wherein the scanning signal is generated by synchronizing with the vertical synchronizing signal of the video signal.

* * * * *